US008512922B2

(12) United States Patent
Ishiduka et al.

(10) Patent No.: US 8,512,922 B2
(45) Date of Patent: Aug. 20, 2013

(54) ELECTROPHOTOGRAPHIC PHOTOSENSITIVE MEMBER, PROCESS CARTRIDGE, AND ELECTROPHOTOGRAPHIC APPARATUS

(75) Inventors: Yuka Ishiduka, Suntou-gun (JP); Wataru Kitamura, Numazu (JP); Kenichi Kaku, Suntou-gun (JP); Mai Murakami, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 322 days.

(21) Appl. No.: 12/903,043

(22) Filed: Oct. 12, 2010

(65) Prior Publication Data

US 2011/0117483 A1 May 19, 2011

(30) Foreign Application Priority Data

Nov. 18, 2009 (JP) ..... 2009-263083
Sep. 17, 2010 (JP) ..... 2010-209419

(51) Int. Cl.
*G03G 5/14* (2006.01)

(52) U.S. Cl.
USPC ..... 430/63; 430/65; 430/60

(58) Field of Classification Search
USPC ..... 430/60, 63, 65
See application file for complete search history.

(56) References Cited

U.S. PATENT DOCUMENTS

| | | | | |
|---|---|---|---|---|
| 5,658,702 | A | 8/1997 | Nukada | |
| 5,795,690 | A * | 8/1998 | Takegawa et al. | 430/58.25 |
| 6,187,493 | B1 * | 2/2001 | Katsukawa et al. | 430/83 |
| 2006/0014092 | A1 | 1/2006 | Nukada | |
| 2009/0010664 | A1 | 1/2009 | Nukada | |
| 2009/0253061 | A1 | 10/2009 | Yagi | |

FOREIGN PATENT DOCUMENTS

| | | | |
|---|---|---|---|
| CN | 101551604 | A | 10/2009 |
| EP | 785477 | A2 | 7/1997 |
| JP | 9-197701 | A | 7/1997 |
| JP | 2004-219904 | A | 8/2004 |
| JP | 2006-030700 | A | 2/2006 |

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

* cited by examiner

*Primary Examiner* — Christopher Rodee
(74) *Attorney, Agent, or Firm* — Canon U.S.A., Inc. IP Division

(57) ABSTRACT

Aspects of the present invention provide an electrophotographic photosensitive member in which an intermediate layer contains metal oxide particles, an organic resin, and a specific compound (fluorenone derivative), and a process cartridge and an electrophotographic apparatus including the electrophotographic photosensitive member.

7 Claims, 2 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, and a process cartridge and an electrophotographic apparatus including the electrophotographic photosensitive member.

2. Description of the Related Art

In recent years, an electrophotographic photosensitive member (organic electrophotographic photosensitive member) including an intermediate layer that contains an inorganic compound and a photosensitive layer that contains a charge generating substance and a charge transporting substance and is disposed on the intermediate layer has been used as an electrophotographic photosensitive member used for electrophotographic apparatuses.

The potential characteristics (chargeability and sensitivity) of the electrophotographic photosensitive member depend on the types of materials used for the intermediate layer and the photosensitive layer. In particular, the potential characteristics of the electrophotographic photosensitive member are significantly dependent on materials such as metal oxide particles, an organic compound, and a binder resin used for the intermediate layer. Thus, the potential characteristics of the electrophotographic photosensitive member can be improved through the structures and combination of the above-described materials.

With a recent increase in the processing speed of electrophotographic apparatuses, in addition to the improvement in potential characteristics such as the increases in chargeability and sensitivity, the potential variation (changes in chargeability and sensitivity) after repeated use needs to be further suppressed. Specifically, the potential variations (changes in chargeability and sensitivity) in terms of (1) and (2) below need to be further suppressed:

(1) Long-term repeated use from the initial use of an electrophotographic photosensitive member to the end of the life of the electrophotographic photosensitive member; and (2) Relatively short-term repeated use (e.g., from the first image output to the completion of about 1000 continuous outputs).

In view of (1) above, the potential variation may be increased depending on the configuration of the electrophotographic photosensitive member (the potential characteristics may be significantly degraded). In such a case, even if the electrophotographic photosensitive member is left to stand after long-term repeated use, the potential characteristics do not return to the original level, which means low recoverability.

In the case where the potential variation is large in view of (2) above, for example, the color of an image formed on the first output sheet sometimes becomes different from that of an image formed on the 1000th sheet. However, such a short-term potential variation is easily recovered by leaving the electrophotographic photosensitive member so that the potential characteristics return to the original level within a relatively short time.

It is believed that the potential variation of (1) is caused by accumulating the potential variations of (2) that are not recovered within a short time even if the electrophotographic photosensitive member is left to stand.

It is important to suppress the potential variations of (1) and (2) above and thus allow an electrophotographic photosensitive member to always stably output an image. In particular, the potential variation of (2) above is problematic, and the change in color needs to be small in any circumstances.

In other words, the potential variation of (2) above at the beginning of use of an electrophotographic photosensitive member needs to be suppressed, or the potential variation of (2) above after the long-term repeated use of the electrophotographic photosensitive member needs to be suppressed.

Japanese Patent Laid-Open No. 2006-30700 discloses a technology that suppresses a potential variation by providing an acceptor compound (organic compound) to a metal oxide as a material constituting an intermediate layer of an electrophotographic photosensitive member. Japanese Patent Laid-Open No. 2004-219904 discloses a technology that suppresses a potential variation by disposing a dye (organic compound) on the surface of a metal oxide, the dye absorbing light with a wavelength of 450 to 950 nm. However, neither focuses on the potential variation of (2) above.

Japanese Patent Laid-Open No. 09-197701 discloses an intermediate layer including an organic metal compound such as an organic zirconium compound, an electron-accepting compound (organic compound), and a binder resin in a mixed manner. However, the potential variation of (2) is not mentioned.

The electrophotographic photosensitive members disclosed in Japanese Patent Laid-Open No. 2006-30700, Japanese Patent Laid-Open No. 2004-219904, and Japanese Patent Laid-Open No. 09-197701 certainly each had a small potential variation of (2) when used for a short time at the beginning of use of the electrophotographic photosensitive member. However, when a short-term potential variation ((2) above) after the long-term repeated use of the electrophotographic photosensitive member ((1) above) was measured, the potential variation was increased compared with the initially measured potential variation.

Regardless of the degree of potential variation after long-term repeated use, the short-term potential variation after the long-term repeated use was increased compared with the initially measured short-term potential variation.

SUMMARY OF THE INVENTION

Aspects of the present invention provide an electrophotographic photosensitive member including a support, an intermediate layer formed on the support, and a photosensitive layer formed on the intermediate layer, wherein the intermediate layer contains metal oxide particles, an organic resin, and a compound represented by the general formula (1) below.

(1)

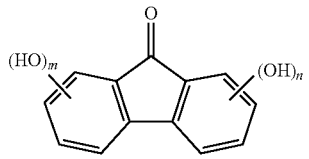

In the general formula (1), m is selected from 0 to 4 and n is selected from 1 to 4.

Aspects of the present invention can also provide a process cartridge and an electrophotographic apparatus including the above-described electrophotographic photosensitive member.

Further features of the present invention will become apparent from the following description of exemplary embodiments with reference to the attached drawing.

DESCRIPTION OF THE EMBODIMENTS

Figure 1:
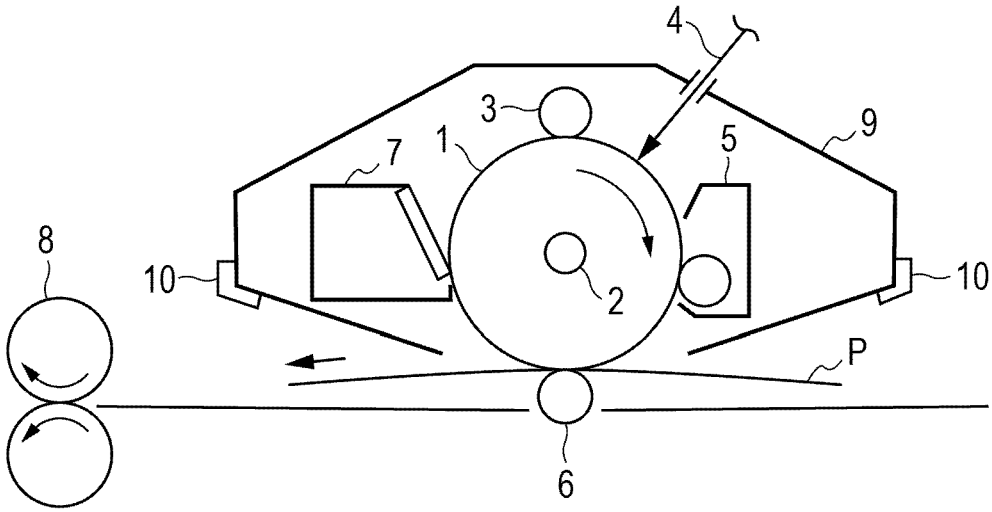
FIG. 1 shows an example of a schematic structure of an electrophotographic apparatus having a process cartridge including an electrophotographic photosensitive member according to aspects of the present invention.

In one aspect of the present invention, an intermediate layer of an electrophotographic photosensitive member comprises metal oxide particles, an organic resin, and a compound (fluorenone derivative) represented by the general formula (1) below.

(1)

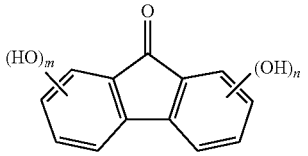

In the general formula (1), m is selected from 0 to 4 and n is selected from 1 to 4.

A detailed mechanism with which the short-term potential variation after the long-term repeated use is improved by incorporating a compound represented by the general formula (1) in an intermediate layer is not clarified. The inventors of the present invention consider the reason may be as follows.

The inventors consider that the compound represented by the general formula (1) interacts with metal oxide particles, whereby an intramolecular charge-transfer complex is formed and the compound easily receives electrons. For example, it is believed that, because of the interaction, the compound smoothly receives electrons from a photosensitive layer (charge generating layer) and smoothly gives and receives electrons with metal oxide particles by drawing electrons from the metal oxide particles.

Examples of the compound represented by the general formula (1) are shown below, but the present invention is not limited thereto.

(1-1)

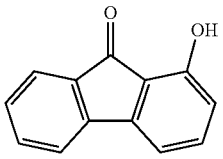

(1-2)

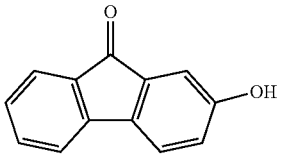

-continued (1-3)

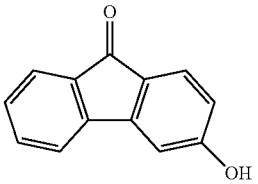

(1-4)

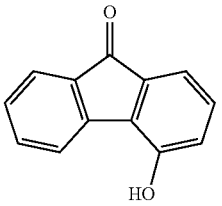

(1-5)

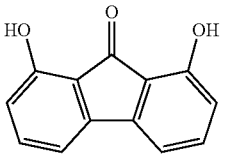

(1-6)

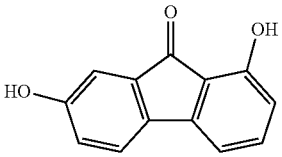

(1-7)

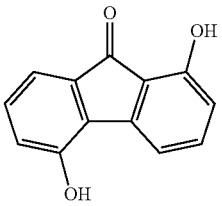

Among these compounds, the compounds (1-1) to (1-4) may be provided in aspects of the invention, such as the compounds (1-1) and (1-2).

According to aspects of the present invention, the intermediate layer can contain the compound represented by the general formula (1) in an amount of 0.05% or more and 4.00% or less by mass relative to the amount of the metal oxide particles. When the amount is 0.05% or more by mass, the effect of suppressing charge variation is increased, the effect being caused by the interaction between the compound and the metal oxide particles. When the amount is 4.00% or less by mass, the interaction between the compounds is suppressed and thus the above-described effect is increased.

According to aspects of the present invention, the intermediate layer can contain an organic resin in an amount of 10% or more and 50% or less by mass relative to the amount of the metal oxide particles. When the amount is 10% or more by mass, cracks are not easily generated on the surface of the intermediate layer, which increases potential stability. When the amount is 50% or less by mass, the distance between the metal oxide particles that interact with the compound represented by the general formula (1) in the intermediate layer is decreased, which increases the amount of electrons flowing. Consequently, potential variation is further suppressed.

According to aspects of the present invention, examples of the metal oxide particles contained in the intermediate layer include particles of titanium oxide, zinc oxide, tin oxide, zirconium oxide, and aluminum oxide. The metal oxide particles may be particles obtained by surface-treating a metal oxide with a surface-treating agent such as a silane coupling agent. Among the metal oxide particles, zinc oxide particles may be used according to one aspect because they produce a large effect of suppressing charge variation.

According to aspects of the present invention, examples of the organic resin contained in the intermediate layer include acrylic resins, allyl resins, alkyd resins, ethyl cellulose resins, ethylene-acrylic acid copolymers, epoxy resins, casein resins, silicone resins, gelatin resins, phenol resins, butyral resins, polyacrylate, polyacetal, polyamide-imide, polyamide, poly(allyl ether), polyimide, polyurethane, polyester, polyethylene, polycarbonate, polystyrene, polysulfone, polyvinyl alcohol, polybutadiene, and polypropylene. Among the organic resins, polyamide and polyurethane may be used according to one aspect because they produce a large effect of suppressing charge variation.

Figure 2:
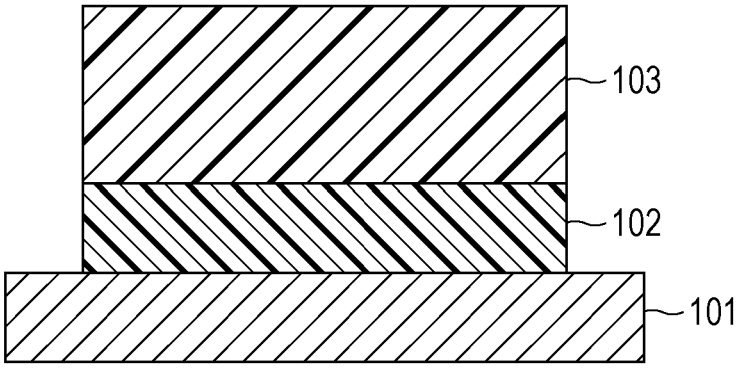
FIG. 2 shows an example of layer structures of an electrophotographic photosensitive member according to aspects of the present invention.

The electrophotographic photosensitive member according to aspects of the present invention includes a support, an intermediate layer formed on the support, and a photosensitive layer formed on the intermediate layer. In FIG. 2, 101 denotes a support, 102 denotes an intermediate layer, and 103 denotes a photosensitive layer. The electrophotographic photosensitive member may include, as the photosensitive layer, a stacked photosensitive layer including a charge generating layer formed on the intermediate layer and a charge transporting layer formed on the charge generating layer.

Any support may be used as long as it has conductivity (conductive support). For example, a support made of a metal such as aluminum or an alloy such as an aluminum alloy or stainless steel can be used. Alternatively, the above-described metal support or a plastic support having a layer formed by vacuum deposition using aluminum, an aluminum alloy, an indium oxide-tin oxide alloy, or the like can also be used. Other examples of the support include a support obtained by impregnating plastic or paper with conductive particles such as carbon black, tin oxide particles, titanium oxide particles, or silver particles together with an appropriate binder resin and a plastic support having a conductive binder resin. The support can have a cylindrical or belt-like shape, and according to one aspect a cylindrical shape may be more suitable.

The surface of the support may be subjected to cutting treatment, surface roughening treatment, or anodizing treatment to suppress interference fringes caused by scattering of laser beams.

A conductive layer may be formed between the support and the intermediate layer to suppress interference fringes caused by scattering of laser beams and to cover scratches formed on the support. The conductive layer can be formed by dispersing conductive particles such as carbon black in a binder resin. The thickness of the conductive layer may be 5 to 40 μm, such as 10 to 30 μm.

The intermediate layer is formed between the support or the conductive layer and the photosensitive layer (charge generating layer and charge transporting layer).

According to aspects of the present invention, an intermediate layer coating solution for forming the intermediate layer may be obtained by dispersing the metal oxide particles and the compound represented by the general formula (1) together with the organic resin and a solvent. Alternatively, an intermediate layer coating solution may be obtained by dispersing the metal oxide particles and the compound represented by the general formula (1) in a solvent, adding a solution having the organic resin dissolved therein to the resultant dispersion solution, and performing further dispersion treatment. The intermediate layer of the electrophotographic photosensitive member according to aspects of the present invention can be formed by applying the coating solution obtained by the above-described method and then drying the coating solution. The dispersion can be performed by a method that uses, for example, a homogenizer, an ultrasonic disperser, a ball mill, a sand mill, a roll mill, a vibration mill, an attritor, or a liquid collision high speed disperser.

The solvent used for the intermediate layer coating solution can be selected in consideration of the organic resin used and dispersion stability. Examples of an organic solvent include alcohols, sulfoxides, ketones, ethers, esters, aliphatic halogenated hydrocarbons, and aromatic compounds.

The intermediate layer of the electrophotographic photosensitive member according to aspects of the present invention may optionally contain organic resin fine particles and a leveling agent.

The thickness of the intermediate layer may be 0.5 to 20 μm, such as 0.6 to 5 μm in view of suppressing of charge variation.

Examples of a charge generating substance include azo pigments such as monoazo, disazo, and trisazo pigments; phthalocyanine pigments such as metal phthalocyanines and non-metal phthalocyanines; indigo pigments such as indigo and thioindigo; perylene pigments such as perylene anhydrides and perylene imide; polycyclic quinone pigments such as anthraquinone, pyrenequinone, and dibenzpyrenequinone; squarylium dyes; pyrylium salts and thiapyrylium salts; triphenylmethane pigments; inorganic substances such as selenium, selenium-tellurium, and amorphous silicon; quinacridone pigments; azulenium salt pigments; cyanine dyes such as quinocyanine; anthanthrone pigments; pyranthrone pigments; xanthene dyes; quinoneimine dyes; styryl dyes; cadmium sulfide; and zinc oxide. These charge generating substances may be used alone or in combination.

Among these charge generating substances, phthalocyanine pigments and azo pigments may be provided according to one aspect of the invention, and phthalocyanine pigments may be provided in view of sensibility.

Among the phthalocyanine pigments, in particular, oxytitanium phthalocyanine, chlorogallium phthalocyanine, and hydroxygallium phthalocyanine display high charge-generating efficiency.

Furthermore, in view of potential characteristics, a hydroxygallium phthalocyanine crystal having strong peaks at Bragg angles 2θ of 7.4°±0.3° and 28.2°±0.3° in the X-ray diffraction spectrum measured using a CuKα characteristic X-ray may be used in hydroxygallium phthalocyanines.

According to aspects of the present invention, X-ray diffraction spectrum was measured using a CuKα characteristic X-ray under the following conditions.

Measuring instrument: Full-automatic X-ray diffraction apparatus MXP18 manufactured by MAC Science Co. Ltd.

X-ray tube: Cu
Tube voltage: 50 kV
Tube current: 300 mA
Scanning method: 2θ/θ scan
Scanning speed: 2 deg./min
Sampling interval: 0.020 deg.
Start angle (2θ): 5 deg.
Stop angle (2θ): 40 deg.
Divergence slit: 0.5 deg.
Scattering slit: 0.5 deg.
Receiving slit: 0.3 deg.
Curved monochromator: use When the photosensitive layer is a stacked photosensitive layer, examples of the binder resin used in the charge generating layer include acrylic resins, allyl resins, alkyd resins, epoxy resins, diallyl phthalate resins, styrene-butadiene copolymers, butyral resins, benzal resins, polyacrylate, polyacetal, polyamide-imide, polyamide, poly(allyl ether), polyarylate, polyimide, polyurethane, polyester, polyethylene, polycarbonate, polystyrene, polysulfone, polyvinyl acetal, polybutadiene, polypropylene, methacrylic resins, urea resins, vinyl chloride-vinyl acetate copolymers, vinyl acetate resins, and vinyl chloride resins. Butyral resins can be used according to one aspect of the invention. These binder resins can be used alone, or in combination as a mixture or a copolymer.

The charge generating layer can be formed by applying a charge-generating-layer coating solution obtained by dispersing the charge generating substance together with the binder resin and a solvent, and then by drying the coating solution. The dispersion can be performed by a method that uses, for example, a homogenizer, an ultrasonic disperser, a ball mill, a sand mill, a roll mill, a vibration mill, an attritor, or a liquid collision high speed disperser. The ratio of the charge generating substance to the binder resin can be 0.3:1 to 10:1 by mass.

The solvent used for the charge-generating-layer coating solution can be selected in consideration of the solubility and dispersion stability of the binder resin and the charge generating substance used. Examples of an organic solvent include alcohols, sulfoxides, ketones, ethers, esters, aliphatic halogenated hydrocarbons, and aromatic compounds.

The thickness of the charge generating layer may be 5 μm or less, such as 0.1 μm or more and 2 μm or less. Various additives such as a sensitizer, an antioxidant, an ultraviolet absorber, and a plasticizer can be optionally added to the charge generating layer.

Examples of a charge transporting substance include triarylamine compounds, hydrazone compounds, styryl compounds, stilbene compounds, and butadiene compounds. Among these compounds, triarylamine compounds may be provided in view of achieving high mobility of charges.

When the photosensitive layer is a stacked photosensitive layer, examples of the binder resin used in the charge transporting layer include acrylic resins, acrylonitrile resins, allyl resins, alkyd resins, epoxy resins, silicone resins, phenol resins, phenoxy resins, polyacrylamide, polyamide-imide, polyamide, poly(allyl ether), polyarylate, polyimide, polyurethane, polyester, polyethylene, polycarbonate, polysulfone, polyphenylene oxide, polybutadiene, polypropylene, and methacrylic resins. Polyarylate and polycarbonate can be used according to one aspect of the invention. These binder resins can be used alone, or in combination as a mixture or a copolymer.

The charge transporting layer can be formed by applying a charge-transporting-layer coating solution obtained by dissolving the charge transporting substance and the binder resin in a solvent, and then by drying the coating solution. The ratio of the charge transporting substance to the binder resin can be 0.3:1 to 10:1 by mass. The drying temperature may be 60° C. or higher and 150° C. or lower, such as 80° C. or higher and 120° C. or lower to suppress cracks. The drying time may be 10 minutes or longer and 60 minutes or shorter.

Examples of the solvent used for the charge-transporting-layer coating solution include alcohols (particularly alcohols having 3 or more carbon atoms) such as propanol and butanol; aromatic hydrocarbons such as anisole, toluene, xylene, and chlorobenzene; methylcyclohexane; and ethylcyclohexane.

In the case where the charge transporting layer has a layered structure, a charge transporting layer on the surface side of the electrophotographic photosensitive member can be cured by polymerizing and/or cross-linking a charge transporting substance having a chain-polymerizable functional group to increase the mechanical strength of the electrophotographic photosensitive member. Examples of the chain-polymerizable functional group include an acrylic group, an alkoxysilyl group, and an epoxy group. To polymerize and/or cross-link the charge transporting substance having a chain-polymerizable functional group, heat, light, or radiation (e.g., electron beam) can be used.

In the case where the charge transporting layer of the electrophotographic photosensitive member has a single-layer structure, the thickness of the charge transporting layer may be 5 μm or more and 40 μm or less, such as 8 μm or more and 30 μm or less.

In the case where the charge transporting layer has a layered structure, the thickness of a charge transporting layer on the support side of the electrophotographic photosensitive member can be 5 μm or more and 30 μm or less and the thickness of a charge transporting layer on the surface side of the electrophotographic photosensitive member can be 1 μm or more and 10 μm or less.

Various additives such as an antioxidant, an ultraviolet absorber, and a plasticizer can be optionally added to the charge transporting layer.

A protective layer may be formed on the photosensitive layer to protect the photosensitive layer. The protective layer can be formed by applying a protective layer coating solution obtained by dissolving the above-described binder resins in a solvent, and then by drying the coating solution. Alternatively, the protective layer may be formed by applying a protective layer coating solution obtained by dissolving resin monomers or oligomers in a solvent, and then by curing and/or drying the coating solution. Light, heat, or radiation (e.g., electron beam) can be used for the curing.

The thickness of the protective layer may be 0.5 μm or more and 10 μm or less, such as 1 μm or more and 7 μm or less. Conductive particles can be optionally added to the protective layer.

The coating solution for each of the layers can be applied by dipping (dip coating), spray coating, spinner coating, roller coating, Meyer bar coating, blade coating, or the like.

A lubricant such as silicone oil, wax, polytetrafluoroethylene particles, silica particles, alumina particles, or boron nitride may be contained in the outermost layer (surface layer) of the electrophotographic photosensitive member.

FIG. 1 shows a schematic structure of an electrophotographic apparatus having a process cartridge including the electrophotographic photosensitive member according to an aspect of the present invention.

In FIG. 1, a cylindrical electrophotographic photosensitive member 1 according to an aspect of the present invention is rotated about a shaft 2 at a predetermined peripheral speed (processing speed) in a direction indicated by an arrow. In the rotation, the surface of the electrophotographic photosensitive member 1 is uniformly charged at a predetermined positive or negative potential by a charging unit 3 (a first charging unit such as a charging roller). Next, the electrophotographic photosensitive member 1 is irradiated with exposure light 4, which is reflected light from an original, that is output from an exposure unit (not shown) providing slit exposure or laser beam scanning exposure and that is intensity-modulated in accordance with a time-series electrical digital pixel signal of intended image information. Thus, an electrostatic latent image corresponding to the intended image information is sequentially formed on the surface of the electrophotographic photosensitive member 1.

The electrostatic latent image formed on the surface of the electrophotographic photosensitive member 1 is developed with charged particles (toner) contained in a developer in a developing unit 5, by normal or reversal developing, and thus a toner image is formed. The toner image formed and carried on the surface of the electrophotographic photosensitive member 1 is then sequentially transferred onto a transfer medium P by a transferring bias from a transferring unit (e.g., a transfer roller) 6. In this process, the transfer medium P is fed from a transfer medium feeding unit (not shown) into a portion (contact portion) between the electrophotographic photosensitive member 1 and the transferring unit 6 in synchronization with the rotation of the electrophotographic photosensitive member 1. In addition, a bias voltage having a polarity opposite to the charge polarity of the toner is applied to the transferring unit 6 from a bias power source (not shown).

In the case where the transfer medium P on which the toner image has been transferred is a final transfer medium (paper, film, or the like), the transfer medium P is separated from the surface of the electrophotographic photosensitive member and conveyed to a fixing unit 8 where the toner image is subjected to a fixing process. After the fixing process, the transfer medium is printed out as an image-formed matter (print or copy) to the outside of the electrophotographic apparatus. In the case where the transfer medium P is an intermediate transfer member, after a plurality of transfer steps, a fixing process is performed, and a final transfer medium is printed out.

A deposition, such as the developer (toner) left on the surface of the electrophotographic photosensitive member 1 from which the toner image has been transferred to the transfer medium, is removed by a cleaning unit 7 (e.g., cleaning blade). In recent years, a cleanerless system has been studied, and thus the toner left without being transferred can be directly collected by a developing unit or the like. Furthermore, the surface of the electrophotographic photosensitive member 1 is de-charged by pre-exposure light (not shown) from a pre-exposure unit (not shown), and is then repeatedly used for image formation. As shown in FIG. 1, in the case where the charging unit 3 is a contact charging unit that uses a charging roller or the like, pre-exposure is not necessarily required.

According to aspects of the present invention, two or more of the components described above, such as the electrophotographic photosensitive member 1, the charging unit 3, the developing unit 5, the cleaning unit 7, and the like, may be accommodated in a container and integrally combined together to constitute a process cartridge. The process cartridge may be detachably mountable to the main body of an electrophotographic apparatus such as a copying machine or a laser beam printer. For example, at least one of the charging unit 3, the developing unit 5, and the cleaning unit 7 can be integrally supported together with the electrophotographic photosensitive member 1 to constitute a process cartridge 9, which is detachably mountable to the main body of the electrophotographic apparatus by using a guiding unit 10 such as a rail of the main body of the electrophotographic apparatus.

In the case where the electrophotographic apparatus is a copying machine or a printer, the exposure light 4 is reflected light or transmitted light from an original. Alternatively, the exposure light 4 is light applied by scanning with a laser beam according to signals into which an original read by a sensor is converted, or driving of an LED array or a liquid-crystal shutter array.

The electrophotographic photosensitive member according to aspects of the present invention can be generally applied to various electrophotographic apparatuses such as electrophotographic copying machines, laser beam printers, LED printers, FAX machines, and liquid-crystal shutter printers. Furthermore, the electrophotographic photosensitive member according to aspects of the present invention can be widely applied to devices such as display, recording, near-print, plate making, and facsimile devices to which electrophotographic techniques are applied.

Aspects of the present invention will now be more specifically described based on Examples, but is not limited thereto. In Examples, the term "part(s)" refers to "part(s) by mass".

EXAMPLES

Example 1

An aluminum cylinder, which is a drawn tube having a diameter of 30 mm and a length of 357.5 mm, was used as a support.

Next, 50 parts of titanium oxide particles coated with tin oxide that contains 10% antimony oxide, 25 parts of resole phenolic resin, 20 parts of methyl cellosolve, 5 parts of methanol, and 0.002 parts of silicone oil (polydimethylsiloxane-polyoxyalkylene copolymer with an average molecular weight of 3000) were dispersed for 2 hours with a sand mill that uses glass beads having a diameter of 0.8 mm. Subsequently, 3.8 parts of silicone resin particles (product name: Tospearl 120 manufactured by Toshiba Silicone Co., Ltd.) were added thereto, and the mixture was stirred for 5 hours to prepare a conductive layer coating solution. The conductive layer coating solution was applied on the support by dipping, and the resultant film was dried at 140° C. for 30 minutes to form a conductive layer having a thickness of 20 μm.

Next, an intermediate layer coating solution was prepared by the method below.

The materials below were mixed and then dispersed for 15 hours with a paint shaker that uses 60 parts of zirconium beads having a diameter of 0.3 mm to prepare an intermediate layer coating solution:

Metal oxide particles: 4 parts of titanium oxide particles (product name: TKP-101 manufactured by TAYCA Corporation);

Organic resin solution: 30.8 parts of a solution prepared by dissolving 10 parts of N-methoxymethylated 6-nylon resin (product name: Toresin EF-30T manufactured by Nagase ChemteX Corporation, methoxymethylation ratio: 28 to 33% by mass) in 90 parts of methanol (in the solution, the content of N-methoxymethylated 6-nylon was 3.08 parts and 77% by mass relative to that of the metal oxide particles);

The compound represented by the general formula (1): 0.0016 parts of the compound represented by the structural formula (1-1) (the content is 0.04% by mass relative to that of the metal oxide particles); and Solvent: 14 parts of 1-butanol.

The intermediate layer coating solution was applied on the conductive layer by dipping, and the resultant film was dried at 100° C. for 10 minutes to form an intermediate layer having a thickness of 1.2 μm.

Subsequently, 4 parts of hydroxygallium phthalocyanine crystals (charge generating substance) having strong peaks at Bragg angles 2θ±0.2° of 7.4° and 28.1° in the X-ray diffraction spectrum measured using a CuKα characteristic X-ray and 0.04 parts of the compound represented by the structural formula (A) below were added to a solution obtained by dissolving 2 parts of polyvinyl butyral (product name: S-LEC BX-1 manufactured by Sekisui Chemical Co., Ltd.) in 100 parts of cyclohexanone. The mixture was then dispersed with a sand mill that uses glass beads having a diameter of 1 mm at 23±3° C. for 1 hour. After that, 100 parts of ethyl acetate was added thereto and thus a charge-generating-layer coating solution was prepared. The charge-generating-layer coating solution was applied on the intermediate layer by dipping, and the resultant film was dried at 90° C. for 10 minutes to form a charge generating layer having a thickness of 0.21 μm.

(A)

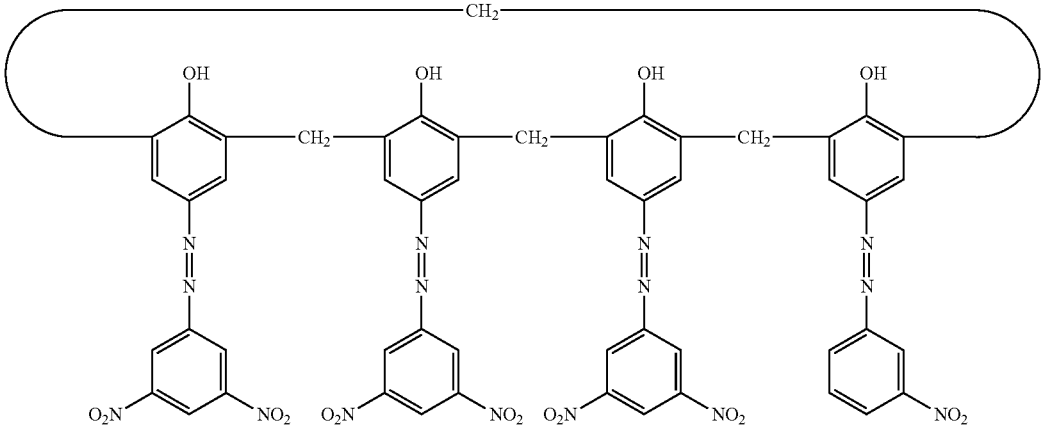

Next, 50 parts of an amine compound represented by the structural formula (B) below, 50 parts of an amine compound represented by the structural formula (C) below, and 100 parts of polycarbonate (product name: Iupilon 2400 manufactured by MITSUBISHI GAS CHEMICAL Company, Inc.) were dissolved in a mixed solvent of 650 parts of chlorobenzene and 150 parts of methylal to prepare a charge-transporting-layer (first-charge-transporting-layer) coating solution. The charge-transporting-layer coating solution, which was left for one day after the solution became homogeneous, was applied on the charge generating layer by dipping, and the resultant film was dried at 110° C. for 60 minutes to form a charge transporting layer (first charge transporting layer) having a thickness of 18 μm.

(B)

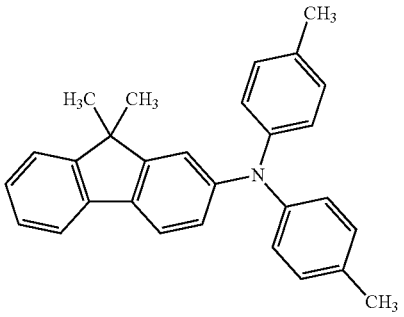

(C)

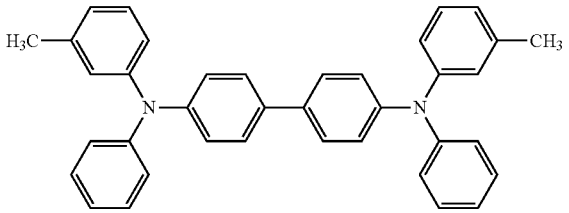

Next, 45 parts of a compound (a charge transporting substance (hole transportable compound) having an acrylic group that is a chain-polymerizable functional group) represented by the structural formula (D) below and 55 parts of n-propanol were mixed and dispersed with an ultra-high pressure disperser to prepare a surface layer (second-charge-transporting-layer) coating solution. The surface layer coating solution was applied on the first charge transporting layer by dipping, and the resultant film was dried at 50° C. for 5 minutes. The film was then irradiated with an electron beam at an acceleration voltage of 70 kV at an absorbed dose of 8000 Gy and thus cured. The film was subjected to heat treatment for 3 minutes so as to be heated at 120° C. The oxygen concentration from the irradiation with an electron beam to the 3-minute heat treatment was 20 ppm. Subsequently, the film was subjected to heat treatment in the air for 30 minutes so as to be heated at 100° C., whereby a surface layer (second charge transporting layer) having a thickness of 5 μm was formed.

(D)

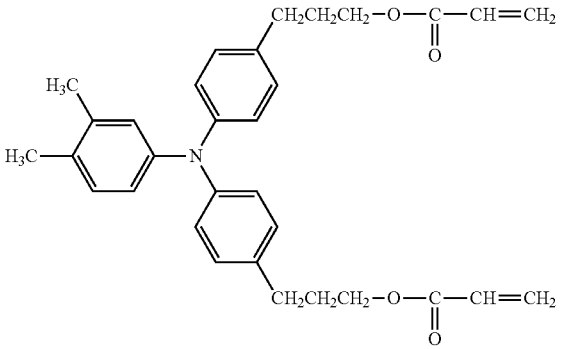

Accordingly, an electrophotographic photosensitive member including the support, the conductive layer, the intermediate layer, the charge generating layer, the charge transporting layer (first charge transporting layer), and the surface layer (second charge transporting layer) in that order was produced.

Examples 2 to 28

Electrophotographic photosensitive members were produced in the same manner as in Example 1, except that the types and amounts of the metal oxide particles, the organic resin, and the compound represented by the general formula (1) used for preparing the intermediate layer coating solution of Example 1 were changed to those shown in Table 1.

TABLE 1

| | Metal oxide particles | | Organic resin | | | Compound represented by the general formula (1) | | |
|---|---|---|---|---|---|---|---|---|
| | Type of metal oxide particles | Amount used [part] | Type of organic resin | Amount used [part] | Ratio of organic resin to metal oxide particles [% by mass] | Type of compound represented by the general formula (1) | Amount used [part] | Ratio of compound to metal oxide particles [% by mass] |
| Ex. 1 | Titanium oxide particles (TKP-101) | 4 | N-methoxymethylated 6-nylon resin | 3.08 | 77 | (1-1) | 0.0016 | 0.04 |
| Ex. 2 | Titanium oxide particles (TKP-101) | 4 | N-methoxymethylated 6-nylon resin | 3.08 | 77 | (1-1) | 0.2 | 5 |
| Ex. 3 | Titanium oxide particles (TKP-101) | 4 | N-methoxymethylated 6-nylon resin | 3.08 | 77 | (1-2) | 0.0016 | 0.04 |
| Ex. 4 | Titanium oxide particles (TKP-101) | 4 | N-methoxymethylated 6-nylon resin | 3.08 | 77 | (1-2) | 0.2 | 5 |
| Ex. 5 | Zinc oxide particles (MZ-500) | 4 | N-methoxymethylated 6-nylon resin | 2.2 | 55 | (1-1) | 0.0016 | 0.04 |
| Ex. 6 | Zinc oxide particles (MZ-500) | 4 | N-methoxymethylated 6-nylon resin | 2.2 | 55 | (1-1) | 0.2 | 5 |
| Ex. 7 | Zinc oxide particles (MZ-500) | 4 | N-methoxymethylated 6-nylon resin | 2.2 | 55 | (1-2) | 0.0016 | 0.04 |
| Ex. 8 | Zinc oxide particles (MZ-500) | 4 | N-methoxymethylated 6-nylon resin | 2.2 | 55 | (1-2) | 0.2 | 5 |
| Ex. 9 | Titanium oxide particles (TKP-101) | 4 | N-methoxymethylated 6-nylon resin | 3.08 | 77 | (1-1) | 0.002 | 0.05 |
| Ex. 10 | Titanium oxide particles (TKP-101) | 4 | N-methoxymethylated 6-nylon resin | 3.08 | 77 | (1-1) | 0.08 | 2 |
| Ex. 11 | Titanium oxide particles (TKP-101) | 4 | N-methoxymethylated 6-nylon resin | 3.08 | 77 | (1-1) | 0.16 | 4 |
| Ex. 12 | Titanium oxide particles (TKP-101) | 4 | N-methoxymethylated 6-nylon resin | 3.08 | 77 | (1-2) | 0.16 | 4 |
| Ex. 13 | Zinc oxide particles (MZ-500) | 4 | N-methoxymethylated 6-nylon resin | 2.2 | 55 | (1-1) | 0.002 | 0.05 |
| Ex. 14 | Zinc oxide particles (MZ-500) | 4 | N-methoxymethylated 6-nylon resin | 2.2 | 55 | (1-1) | 0.08 | 2 |
| Ex. 15 | Zinc oxide particles (MZ-500) | 4 | N-methoxymethylated 6-nylon resin | 2.2 | 55 | (1-1) | 0.16 | 4 |
| Ex. 16 | Zinc oxide particles (MZ-500) | 4 | N-methoxymethylated 6-nylon resin | 0.36 | 9 | (1-1) | 0.16 | 4 |
| Ex. 17 | Zinc oxide particles (MZ-500) | 4 | N-methoxymethylated 6-nylon resin | 2.2 | 55 | (1-2) | 0.08 | 2 |
| Ex. 18 | Titanium oxide particles (TKP-101) | 4 | N-methoxymethylated 6-nylon resin | 2 | 50 | (1-1) | 0.08 | 2 |
| Ex. 19 | Titanium oxide particles (TKP-101) | 4 | N-methoxymethylated 6-nylon resin | 1 | 25 | (1-1) | 0.08 | 2 |
| Ex. 20 | Titanium oxide particles (TKP-101) | 4 | N-methoxymethylated 6-nylon resin | 2 | 50 | (1-2) | 0.08 | 2 |
| Ex. 21 | Zinc oxide particles (MZ-500) | 4 | N-methoxymethylated 6-nylon resin | 2 | 50 | (1-1) | 0.08 | 2 |
| Ex. 22 | Zinc oxide particles (MZ-500) | 4 | N-methoxymethylated 6-nylon resin | 1.6 | 40 | (1-1) | 0.08 | 2 |
| Ex. 23 | Zinc oxide particles (MZ-500) | 4 | N-methoxymethylated 6-nylon resin | 1.32 | 33 | (1-1) | 0.08 | 2 |
| Ex. 24 | Zinc oxide particles (MZ-500) | 4 | N-methoxymethylated 6-nylon resin | 1.12 | 28 | (1-1) | 0.08 | 2 |
| Ex. 25 | Zinc oxide particles (MZ-500) | 4 | N-methoxymethylated 6-nylon resin | 0.8 | 20 | (1-1) | 0.08 | 2 |
| Ex. 26 | Zinc oxide particles (MZ-500) | 4 | N-methoxymethylated 6-nylon resin | 0.4 | 10 | (1-1) | 0.08 | 2 |
| Ex. 27 | Zinc oxide particles (MZ-500) | 4 | N-methoxymethylated 6-nylon resin | 1.32 | 33 | (1-2) | 0.08 | 2 |
| Ex. 28 | Zinc oxide particles (FINEX-50) | 4 | N-methoxymethylated 6-nylon resin | 1.32 | 33 | (1-1) | 0.08 | 2 |

Ex.: Example

"TKP-101" is titanium oxide particles having a crystallite diameter of 6 nm and manufactured by TAYCA Corporation. "MZ-500" is zinc oxide particles having a particle size of 20 to 30 nm and an average primary particle size of 25 μm and manufactured by TAYCA Corporation. "FINEX-50" is zinc oxide particles having an average particle size of 20 nm and manufactured by Sakai Chemical Industry Co., Ltd.

Examples 29 to 34

Electrophotographic photosensitive members were produced in the same manner as in Example 1, except that the types and amounts of the metal oxide particles, the organic resin, and the compound represented by the general formula (1) used for preparing the intermediate layer coating solution of Example 1 were changed to those shown in Table 2. The metal oxide particles were prepared by processing a silane coupling agent on the surfaces of zinc oxide particles (MZ-500 manufactured by TAYCA Corporation) or zinc oxide particles (FINEX-50 manufactured by Sakai Chemical Industry Co., Ltd.) as described below.

That is, 50 parts of zinc oxide particles (MZ-500 manufactured by TAYCA Corporation) or zinc oxide particles (FINEX-50 manufactured by Sakai Chemical Industry Co., Ltd.) and 1.5 parts of trimethoxyvinylsilane (product name: KBM-1003 manufactured by Shin-Etsu Chemical Co., Ltd.) serving as a silane coupling agent were mixed in 200 parts of toluene and caused to react with each other at room temperature for 5 hours. The solvent was then distilled off and vacuum drying was performed at 145° C. for 5 hours to obtain surface-treated zinc oxide particles.

A conductive layer was formed on the support as in Example 1.

Next, an intermediate layer coating solution was prepared by the method below.

That is, 50 parts of zinc oxide (product name: MZ-500 manufactured by TAYCA Corporation) and 0.38 parts of N-2-(aminoethyl)-3-aminopropyltrimethoxysilane (product name: KBM-603 manufactured by Shin-Etsu Chemical Co., Ltd.) serving as a silane coupling agent were mixed in 200 parts of toluene and caused to react with each other at room temperature for 5 hours. The solvent was then distilled off and vacuum drying was performed at 145° C. for 5 hours to obtain surface-treated zinc oxide particles.

Furthermore, 75 parts of polyvinyl butyral (product name: S-LEC BM-1 manufactured by Sekisui Chemical Co., Ltd.) was dissolved in 425 parts of 2-butanone to obtain a polyvinyl butyral solution.

Next, 85 parts of the above-described surface-treated zinc oxide particles, 105 parts of the polyvinyl butyral solution, 15.7 parts of blocked isocyanate (product name: Sumidur BL3175 manufactured by Sumika Bayer Urethane Co., Ltd., the content of NCO group: 11.2%) having a hexamethylene diisocyanate (HDI) skeleton, 150 parts of 1-butanol, 70 parts of 2-butanone, and 0.85 parts of the compound represented by the structural formula (1-1) were mixed and dispersed for 3 hours with a sand mill that uses glass beads having a diameter of 0.8 mm. Subsequently, 4.1 parts of silicone resin particles (product name: Tospearl 145 manufactured by Toshiba Silicone Co., Ltd.) were added thereto and dispersed for 20 minutes. The glass beads were then removed and 0.9 parts of dibutyltin dilaurate and 1 part of silicone oil were added to the dispersion solution. Thus, an intermediate layer coating solution was prepared.

The intermediate layer coating solution was applied on the conductive layer by dipping, and the resultant film was dried and cured at 160° C. for 40 minutes to form an intermediate layer having a thickness of 1 μm.

TABLE 2

| | Metal oxide particles | | Organic resin | | | Compound represented by the general formula (1) | | |
|---|---|---|---|---|---|---|---|---|
| | Type of metal oxide particles | Amount used [part] | Type of organic resin | Amount used [part] | Ratio of organic resin to metal oxide particles [% by mass] | Type of compound represented by the general formula (1) | Amount used [part] | Ratio of compound to metal oxide particles [% by mass] |
| Ex. 29 | Surface-treated zinc oxide particles (MZ-500/KBM-1003) | 4.12 | N-methoxymethylated 6-nylon resin | 0.8 | 20 | (1-1) | 0.08 | 2 |
| Ex. 30 | Surface-treated zinc oxide particles (MZ-500/KBM-1003) | 4.12 | N-methoxymethylated 6-nylon resin | 0.8 | 20 | (1-2) | 0.08 | 2 |
| Ex. 31 | Surface-treated zinc oxide particles (FINEX-50/KBM-1003) | 4.12 | N-methoxymethylated 6-nylon resin | 0.8 | 20 | (1-1) | 0.08 | 2 |
| Ex. 32 | Surface-treated zinc oxide particles (FINEX-50/KBM-1003) | 4.12 | N-methoxymethylated 6-nylon resin | 0.8 | 20 | (1-2) | 0.08 | 2 |
| Ex. 33 | Surface-treated zinc oxide particles (FINEX-50/KBM-1003) | 4.12 | N-methoxymethylated 6-nylon resin | 0.8 | 20 | (1-4) | 0.08 | 2 |
| Ex. 34 | Surface-treated zinc oxide particles (FINEX-50/KBM-1003) | 4.12 | N-methoxymethylated 6-nylon resin | 0.8 | 20 | (1-7) | 0.08 | 2 |

Ex.: Example

"MZ-500/KBM-1003" was obtained by processing trimethoxyvinylsilane (KBM-1003 manufactured by Shin-Etsu Chemical Co., Ltd.) on the surfaces of the zinc oxide particles (MZ-500 manufactured by TAYCA Corporation) through silane coupling. "FINEX-50/KBM-1003" was obtained by processing trimethoxyvinylsilane (KBM-1003 manufactured by Shin-Etsu Chemical Co., Ltd.) on the surfaces of the zinc oxide particles (FINEX-50 manufactured by Sakai Chemical Industry Co., Ltd.) through silane coupling.

The amounts (4.12 parts) of the metal oxide particles of Examples 29 to 34 shown in Table 2 were the total amounts of trimethoxyvinylsilane and zinc oxide particles (metal oxide particles), the total amounts being made up of 0.12 parts of trimethoxyvinylsilane and 4 parts of zinc oxide particles.

Examples 35 to 44

Electrophotographic photosensitive members were produced in the same manner as in Example 1, except that the types and amounts of the metal oxide particles, the organic resin, and the compound represented by the general formula (1) used for preparing the intermediate layer coating solution of Example 1 were changed to those shown in Table 3.

Example 45

As in Example 1, an aluminum cylinder, which is a drawn tube having a diameter of 30 mm and a length of 357.5 mm, was used as a support.

As in Example 1, the charge generating layer, the charge transporting layer (first charge transporting layer), and the surface layer (second charge transporting layer) were formed on the intermediate layer in that order.

Accordingly, an electrophotographic photosensitive member including the support, the conductive layer, the intermediate layer, the charge generating layer, the charge transporting layer (first charge transporting layer), and the surface layer (second charge transporting layer) in that order was produced.

Examples 46 to 52

Electrophotographic photosensitive members were produced in the same manner as in Example 45, except that the types and amounts of the metal oxide particles, the organic resin, and the compound represented by the general formula (1) used for preparing the intermediate layer coating solution of Example 45 were changed to those shown in Table 3.

TABLE 3

| | Metal oxide particles | | Organic resin | | | Compound represented by the general formula (1) | | |
|---|---|---|---|---|---|---|---|---|
| | Type of metal oxide particles | Amount used [part] | Type of organic resin | Amount used [part] | Ratio of organic resin to metal oxide particles [% by mass] | Type of compound represented by the general formula (1) | Amount used [part] | Ratio of compound to metal oxide particles [% by mass] |
| Ex. 35 | Zinc oxide particles (MZ-500) | 4 | N-methoxymethylated 6-nylon resin | 2 | 50 | (1-2) | 0.08 | 2 |
| Ex. 36 | Zinc oxide particles (MZ-500) | 4 | N-methoxymethylated 6-nylon resin | 0.4 | 10 | (1-2) | 0.08 | 2 |
| Ex. 37 | Zinc oxide particles (MZ-500) | 4 | N-methoxymethylated 6-nylon resin | 2 | 50 | (1-3) | 0.0016 | 0.04 |
| Ex. 38 | Zinc oxide particles (MZ-500) | 4 | N-methoxymethylated 6-nylon resin | 2 | 50 | (1-3) | 0.2 | 5 |
| Ex. 39 | Zinc oxide particles (MZ-500) | 4 | N-methoxymethylated 6-nylon resin | 2 | 50 | (1-3) | 0.08 | 2 |
| Ex. 40 | Zinc oxide particles (MZ-500) | 4 | N-methoxymethylated 6-nylon resin | 0.4 | 10 | (1-3) | 0.08 | 2 |
| Ex. 41 | Zinc oxide particles (MZ-500) | 4 | N-methoxymethylated 6-nylon resin | 2 | 50 | (1-4) | 0.0016 | 0.04 |
| Ex. 42 | Zinc oxide particles (MZ-500) | 4 | N-methoxymethylated 6-nylon resin | 2 | 50 | (1-4) | 0.2 | 5 |
| Ex. 43 | Zinc oxide particles (MZ-500) | 4 | N-methoxymethylated 6-nylon resin | 2 | 50 | (1-4) | 0.08 | 2 |
| Ex. 44 | Zinc oxide particles (MZ-500) | 4 | N-methoxymethylated 6-nylon resin | 0.4 | 10 | (1-4) | 0.08 | 2 |
| Ex. 45 | Zinc oxide particles (MZ-500) | 4 | Polyurethane | 2.2 | 55 | (1-1) | 0.0016 | 0.04 |
| Ex. 46 | Zinc oxide particles (MZ-500) | 4 | Polyurethane | 2.2 | 55 | (1-1) | 0.2 | 5 |
| Ex. 47 | Zinc oxide particles (MZ-500) | 4 | Polyurethane | 2.2 | 55 | (1-2) | 0.0016 | 0.04 |
| Ex. 48 | Zinc oxide particles (MZ-500) | 4 | Polyurethane | 2.2 | 55 | (1-2) | 0.2 | 5 |
| Ex. 49 | Zinc oxide particles (MZ-500) | 4 | Polyurethane | 2 | 50 | (1-1) | 0.08 | 2 |
| Ex. 50 | Zinc oxide particles (MZ-500) | 4 | Polyurethane | 0.4 | 10 | (1-1) | 0.08 | 2 |
| Ex. 51 | Zinc oxide particles (MZ-500) | 4 | Polyurethane | 2 | 50 | (1-2) | 0.08 | 2 |
| Ex. 52 | Zinc oxide particles (MZ-500) | 4 | Polyurethane | 0.4 | 10 | (1-2) | 0.08 | 2 |

Ex.: Example

Note that "polyurethane" in Table 3 is polyurethane obtained by the reaction between the polyvinyl butyral and the blocked isocyanate having a hexamethylene diisocyanate (HDI) skeleton described above.

Comparative Example 1

An electrophotographic photosensitive member was produced in the same manner as in Example 18, except that the compound represented by the structural formula (1-1) in Example 18 was changed to a compound represented by the structural formula (E-1) below.

(E-1)

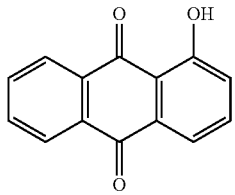

Comparative Example 2

An electrophotographic photosensitive member was produced in the same manner as in Example 18, except that the compound represented by the structural formula (1-1) in Example 18 was changed to a compound represented by the structural formula (E-2) below.

(E-2)

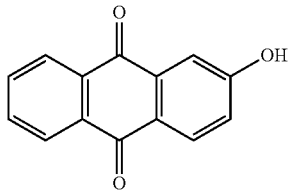

Comparative Example 3

An electrophotographic photosensitive member was produced in the same manner as in Example 23, except that the compound represented by the structural formula (1-1) in Example 23 was changed to a compound represented by the structural formula (E-1) above.

Comparative Example 4

An electrophotographic photosensitive member was produced in the same manner as in Example 23, except that the compound represented by the structural formula (1-1) in Example 23 was changed to a compound represented by the structural formula (E-2) above.

Comparative Example 5

An electrophotographic photosensitive member was produced in the same manner as in Example 23, except that the compound represented by the structural formula (1-1) in Example 23 was changed to a compound represented by the structural formula (E-3) below.

(E-3)

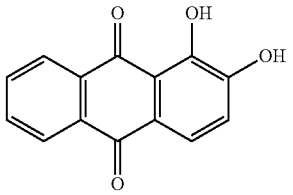

Comparative Example 6

An electrophotographic photosensitive member was produced in the same manner as in Example 29, except that the compound represented by the structural formula (1-1) in Example 29 was changed to a compound represented by the structural formula (E-3) above.

Comparative Example 7

As described below, the compound represented by the structural formula (E-3) was processed on the zinc oxide particles that had been surface-treated with the silane coupling agent used in Example 29 to perform organic compound treatment.

That is, 51.5 parts of zinc oxide particles (1.5 parts of trimethoxyvinylsilane and 50 parts of zinc oxide particles) that had been surface-treated with a silane coupling agent and 1 part of the compound represented by the structural formula (E-3) were mixed in 200 parts of toluene and stirred at room temperature for 3 hours. The solvent was then distilled off and vacuum drying was performed at 50° C. for 3 hours to obtain zinc oxide particles subjected to organic compound treatment.

An electrophotographic photosensitive member was produced in the same manner as in Example 29, except that the metal oxide particles of Example 29 were changed to 4.2 parts of the zinc oxide particles (including 0.12 parts of trimethoxyvinylsilane, 0.08 parts of the compound represented by the structural formula (E-3), and 4 parts of zinc oxide particles) subjected to organic compound treatment, and the compound represented by the structural formula (1-1) was not used.

Comparative Example 8

An electrophotographic photosensitive member was produced in the same manner as in Example 23, except that the compound represented by the structural formula (1-1) in Example 23 was changed to a compound represented by the structural formula (E-4) below.

(E-4)

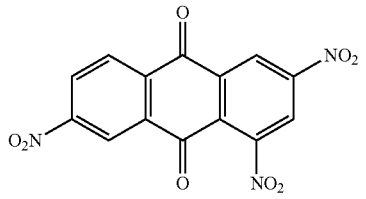

Comparative Example 9

An electrophotographic photosensitive member was produced in the same manner as in Example 23, except that the compound represented by the structural formula (1-1) in Example 23 was changed to a diazo metal complex (product name: Valifast Y1101 manufactured by ORIENT CHEMICAL INDUSTRIES Co., Ltd.).

Comparative Example 10

As described below, a diazo metal complex (product name: Valifast Y1101 manufactured by ORIENT CHEMICAL INDUSTRIES Co., Ltd.) was processed on zinc oxide particles to perform organic compound treatment.

That is, 50 parts of zinc oxide particles (MZ-500 manufactured by TAYCA Corporation), 5 parts of resole phenolic resin, and 1 part of diazo metal complex (Valifast Y1101 manufactured by ORIENT CHEMICAL INDUSTRIES Co., Ltd.) were mixed in 200 parts of methanol and stirred for 2 hours. The solvent was distilled off and vacuum drying was performed at 120° C. for 3 hours to achieve cross-linking. The cross-linked product was crushed using a mortar, and added to 100 parts of methanol and stirred for 1 hour. The solvent was then distilled off and vacuum drying was performed at 100° C. for 2 hours to obtain zinc oxide particles subjected to organic compound treatment.

An electrophotographic photosensitive member was produced in the same manner as in Example 23, except that the metal oxide particles of Example 23 were changed to 4.48 parts of the zinc oxide particles (including 0.48 parts of diazo metal complex and 4 parts of zinc oxide particles) subjected to organic compound treatment, and the compound represented by the structural formula (1-1) was not used.

Comparative Example 11

Five parts of polyvinyl butyral (S-LEC BX-1 manufactured by Sekisui Chemical Co., Ltd.) dissolved in 20 parts of cyclohexanone, 50 parts of 50% by mass toluene solution of zirconium tributoxymonoacetylacetonate (product name: ZC540 manufactured by Matsumoto Trading Co., Ltd.) serving as an organic zirconium compound, and 0.5 parts of the compound represented by the structural formula (1-2) were mixed and dissolved to prepare an intermediate layer coating solution.

An electrophotographic photosensitive member was produced in the same manner as in Example 23, except that the intermediate layer coating solution of Example 23 was changed to the intermediate layer coating solution prepared as described above.

Comparative Example 12

An electrophotographic photosensitive member was produced in the same manner as in Example 18, except that the compound represented by the structural formula (1-1) in Example 18 was not used.

Comparative Example 13

An electrophotographic photosensitive member was produced in the same manner as in Example 23, except that the compound represented by the structural formula (1-1) in Example 23 was not used.

Table 4 shows the types and amounts of the metal oxide particles, the organic resin, and the compound represented by the general formula (1) used for preparing the intermediate layer coating solutions of Comparative Examples 1 to 13.

TABLE 4

| | Metal oxide particles | | Organic resin | | | Compound represented by the general formula (1) | | |
|---|---|---|---|---|---|---|---|---|
| | Type of metal oxide particles | Amount used [part] | Type of organic resin | Amount used [part] | Ratio of organic resin to metal oxide particles [% by mass] | Type of compound represented by the general formula (1) | Amount used [part] | Ratio of compound to metal oxide particles [% by mass] |
| C. E. 1 | Titanium oxide particles (TKP-101) | 4 | N-methoxymethylated 6-nylon resin | 2 | 50 | (E-1) | 0.08 | 2 |
| C. E. 2 | Titanium oxide particles (TKP-101) | 4 | N-methoxymethylated 6-nylon resin | 2 | 50 | (E-2) | 0.08 | 2 |
| C. E. 3 | Zinc oxide particles (MZ-500) | 4 | N-methoxymethylated 6-nylon resin | 1.32 | 33 | (E-1) | 0.08 | 2 |
| C. E. 4 | Zinc oxide particles (MZ-500) | 4 | N-methoxymethylated 6-nylon resin | 1.32 | 33 | (E-2) | 0.08 | 2 |
| C. E. 5 | Zinc oxide particles (MZ-500) | 4 | N-methoxymethylated 6-nylon resin | 1.32 | 33 | (E-3) | 0.08 | 2 |
| C. E. 6 | Surface-treated zinc oxide particles (MZ-500/KBM-1003) | 4.12 | N-methoxymethylated 6-nylon resin | 0.8 | 20 | (E-3) | 0.08 | 2 |
| C. E. 7 | Zinc oxide particles subjected to organic compound treatment (MZ-500/KBM-1003/(E-3)) | 4.2 | N-methoxymethylated 6-nylon resin | 0.8 | 20 | — | — | — |

TABLE 4-continued

| | Metal oxide particles | | Organic resin | | | Compound represented by the general formula (1) | | |
|---|---|---|---|---|---|---|---|---|
| | Type of metal oxide particles | Amount used [part] | Type of organic resin | Amount used [part] | Ratio of organic resin to metal oxide particles [% by mass] | Type of compound represented by the general formula (1) | Amount used [part] | Ratio of compound to metal oxide particles [% by mass] |
| C. E. 8 | Zinc oxide particles (MZ-500) | 4 | N-methoxymethylated 6-nylon resin | 1.32 | 33 | (E-4) | 0.08 | 2 |
| C. E. 9 | Zinc oxide particles (MZ-500) | 4 | N-methoxymethylated 6-nylon resin | 1.32 | 33 | Valifast Y1101 | 0.08 | 2 |
| C. E. 10 | Zinc oxide particles subjected to organic compound treatment (MZ-500/Valifast Y1101) | 4.48 | N-methoxymethylated 6-nylon resin | 1.32 | 33 | — | — | — |
| C. E. 11 | Zirconium tributoxymonoacetylacetonate | 4 | Polyvinyl butyral resin | — | — | (1-2) | 0.08 | 2 |
| C. E. 12 | Titanium oxide particles (TKP-101) | 4 | N-methoxymethylated 6-nylon resin | 2 | 50 | — | — | — |
| C. E. 13 | Zinc oxide particles (MZ-500) | 4 | N-methoxymethylated 6-nylon resin | 1.32 | 33 | — | — | — |

C. E.: Comparative Example

The amount (4.12 parts) of the metal oxide particles of Comparative Example 6 shown in Table 4 was the total amount of trimethoxyvinylsilane and zinc oxide particles (metal oxide particles), the total amount being made up of 0.12 parts of trimethoxyvinylsilane and 4 parts of zinc oxide particles. The amount (4.2 parts) of the metal oxide particles of Comparative Example 7 shown in Table 4 was the total amount of trimethoxyvinylsilane, the compound represented by the structural formula (E-3), and zinc oxide particles (metal oxide particles), the total amount being made up of 0.12 parts of trimethoxyvinylsilane, 0.08 parts of the compound represented by the structural formula (E-3), and 4 parts of zinc oxide particles. The amount (4.48 parts) of the metal oxide particles of Comparative Example 10 shown in Table 4 was the total amount of diazo metal complex and zinc oxide particles (metal oxide particles), the total amount being made up of 0.48 parts of diazo metal complex and 4 parts of zinc oxide particles.

Evaluations

An evaluation method of electrophotographic photosensitive members according to Examples 1 to 52 and Comparative Examples 1 to 13 is as follows.

Potential variation

A copying machine (product name: GP405 manufactured by CANON KABUSHIKI KAISHA, processing speed: 210 mm/s, (primary) charging unit: a rubber roller contact charger (charging roller) that uses a current obtained by superimposing an alternating current on a direct current, exposure unit: an image exposing unit with a laser, developing unit: a noncontact developing system that uses single-component magnetic negative toner, transferring unit: a roller-type contact transferring system, cleaning unit: a cleaner in which a rubber blade is disposed in a counter direction, and pre-exposure unit: a pre-exposure unit that uses a fuse lamp) was used as an evaluation apparatus. The electrophotographic photosensitive members according to Examples 1 to 52 and Comparative Examples 1 to 13 were each installed in the evaluation apparatus.

The evaluation apparatus was installed in an environment of 23° C. and 5% RH. The evaluation apparatus was adjusted so that, when the alternating component of a charging roller was set to be 1500 Vpp and 1500 Hz and the direct component was set to be −850 V, an initial dark potential (Vda) before a long-term durability test and an initial light potential (Vla) before a long-term durability test through exposure with a 780-nanometer laser each had a value of −200 V in each of the electrophotographic photosensitive members.

The surface potential of the electrophotographic photosensitive member was measured by removing a developing cartridge from the evaluation apparatus and inserting a potential measurement device therein. The potential measurement device includes a potential measurement probe disposed at a development position of the developing cartridge. The potential measurement probe was provided in the center of the drum-shaped electrophotographic photosensitive member in the axial direction while being 3 mm away from the surface of the electrophotographic photosensitive member.

Evaluations were performed in accordance with (1) and (2) below. Herein, the evaluations (1) and (2) were performed without changing the initial conditions of the alternating component/direct component and the initial exposure conditions of the electrophotographic photosensitive member. The evaluations were performed after the electrophotographic photosensitive member was left to stand in an environment of 23° C. and 5% RH for 48 hours to allow the electrophotographic photosensitive member to adapt to the environment.

(1) The electrophotographic photosensitive member and the potential measurement device were installed in the evaluation apparatus, and a short-term durability test equivalent to the printing of 999 sheets was performed prior to a long-term durability test without passing sheets to measure a dark potential (Vdb) at the time the printing equivalent to the 999th sheet was performed before a long-term durability test and a light potential (Vlb) at the time the printing equivalent to the 999th sheet was performed before a long-term durability test. The differences between the initial dark potential (Vda) and the dark potential (Vdb) at the time the printing equivalent to the 999th sheet was performed before a long-term durability test and between the initial light potential (Vla) and the light potential (Vlb) at the time the printing equivalent to the 999th sheet was performed before a long-term durability test were confirmed. The differences were respectively referred to as ΔVd(ab) before a long-term durability test and ΔVl(ab) before a long-term durability test.

(Initial dark potential (Vda) before a long-term durability test)−(dark potential (Vdb) at the time the printing equivalent to the 999th sheet was performed before a long-term durability test)=ΔVd(ab) before a long-term durability test (Initial light potential (Vla) before a long-term durability test)−(light potential (Vlb) at the time the printing equivalent to the 999th sheet was performed before a long-term durability test)=ΔVl(ab) before a long-term durability test (2) Subsequently, the potential measurement device was removed and the developing cartridge was installed, and a 50000-sheet long-term durability test was performed with passing sheets. After the completion of the long-term durability test, the evaluation apparatus was left to stand in the same environment (23° C./5% RH) for 24 hours. After that, the developing cartridge was removed and the potential measurement device was installed. A short-term durability test equivalent to the printing of 999 sheets was performed after a long-term durability test in the same manner as in (1) without passing sheets. In this short-term durability test, the differences between the initial dark potential (Vdc) after a long-term durability test and the dark potential (Vdd) at the time the printing equivalent to the 999th sheet was performed after a long-term durability test and between the initial light potential (Vlc) after a long-term durability test and the light potential (Vld) at the time the printing equivalent to the 999th sheet was performed after a long-term durability test were confirmed. The differences were respectively referred to as ΔVd (cd) after a long-term durability test and ΔVl(cd) after a long-term durability test.

(Initial dark potential (Vdc) after a long-term durability test)−(dark potential (Vdd) at the time the printing equivalent to the 999th sheet was performed after a long-term durability test)=ΔVd(cd) after a long-term durability test (Initial light potential (Vlc) after a long-term durability test)−(light potential (Vld) at the time the printing equivalent to the 999th sheet was performed after a long-term durability test)=ΔVl(cd) after a long-term durability test The 50000-sheet durability test (long-term durability test) was performed using A4 paper at a printing percentage of 6% in an intermittent mode (8 seconds per sheet) in which printing is stopped once a single sheet.

Tables 5 and 6 show the evaluation results.

TABLE 5

| | Before long-term durability test | | After long-term durability test | | | |
|---|---|---|---|---|---|---|
| | ΔVd(ab) [V] | ΔVI(ab) [V] | Vdc [V] | VIc [V] | ΔVd(cb) [V] | ΔVI(cb) [V] |
| Ex. 1 | −10 | +10 | 830 | 230 | −30 | +35 |
| Ex. 2 | −10 | +10 | 830 | 230 | −30 | +35 |
| Ex. 3 | −15 | +10 | 825 | 235 | −30 | +35 |
| Ex. 4 | −15 | +10 | 825 | 235 | −30 | +35 |
| Ex. 5 | −10 | +10 | 830 | 230 | −30 | +30 |
| Ex. 6 | −10 | +10 | 830 | 230 | −30 | +30 |
| Ex. 7 | −10 | +10 | 825 | 235 | −30 | +30 |
| Ex. 8 | −10 | +10 | 825 | 235 | −30 | +30 |
| Ex. 9 | −10 | +10 | 835 | 225 | −25 | +30 |
| Ex. 10 | −10 | +10 | 835 | 225 | −25 | +30 |
| Ex. 11 | −10 | +10 | 835 | 225 | −25 | +30 |
| Ex. 12 | −10 | +10 | 830 | 225 | −25 | +30 |
| Ex. 13 | −10 | +10 | 835 | 220 | −20 | +25 |
| Ex. 14 | −10 | +10 | 835 | 220 | −20 | +25 |
| Ex. 15 | −10 | +10 | 835 | 220 | −20 | +25 |
| Ex. 16 | −10 | +10 | 835 | 220 | −20 | +25 |
| Ex. 17 | −10 | +10 | 830 | 220 | −20 | +25 |
| Ex. 18 | −5 | +5 | 840 | 215 | −15 | +20 |
| Ex. 19 | −5 | +5 | 840 | 215 | −15 | +20 |
| Ex. 20 | −5 | +5 | 835 | 220 | −15 | +20 |
| Ex. 21 | −5 | +5 | 840 | 215 | −10 | +15 |
| Ex. 22 | −5 | +5 | 840 | 215 | −10 | +15 |
| Ex. 23 | −5 | +5 | 840 | 215 | −10 | +15 |

TABLE 5-continued

| | Before long-term durability test | | After long-term durability test | | | |
|---|---|---|---|---|---|---|
| | ΔVd(ab) [V] | ΔVI(ab) [V] | Vdc [V] | VIc [V] | ΔVd(cb) [V] | ΔVI(cb) [V] |
| Ex. 24 | −5 | +5 | 840 | 215 | −10 | +15 |
| Ex. 25 | −5 | +5 | 840 | 215 | −10 | +15 |
| Ex. 26 | −5 | +5 | 840 | 215 | −10 | +15 |
| Ex. 27 | −5 | +5 | 835 | 220 | −10 | +15 |
| Ex. 28 | −5 | +5 | 840 | 215 | −10 | +15 |
| Ex. 29 | −5 | +5 | 840 | 215 | −10 | +15 |
| Ex. 30 | −5 | +5 | 835 | 220 | −10 | +15 |
| Ex. 31 | −5 | +5 | 840 | 215 | −10 | +15 |
| Ex. 32 | −5 | +5 | 835 | 220 | −10 | +15 |
| Ex. 33 | −5 | +5 | 830 | 220 | −15 | +20 |
| Ex. 34 | −5 | +5 | 830 | 220 | −15 | +20 |
| Ex. 35 | −10 | +5 | 830 | 225 | −15 | +25 |
| Ex. 36 | −10 | +5 | 830 | 225 | −15 | +25 |
| Ex. 37 | −10 | +5 | 825 | 225 | −15 | +30 |
| Ex. 38 | −10 | +5 | 825 | 225 | −15 | +30 |
| Ex. 39 | −10 | +5 | 830 | 225 | −15 | +25 |
| Ex. 40 | −10 | +5 | 830 | 225 | −15 | +25 |
| Ex. 41 | −10 | +5 | 825 | 225 | −15 | +30 |
| Ex. 42 | −10 | +5 | 825 | 225 | −15 | +30 |
| Ex. 43 | −10 | +5 | 830 | 225 | −15 | +25 |
| Ex. 44 | −10 | +5 | 830 | 225 | −15 | +25 |
| Ex. 45 | −10 | +5 | 830 | 225 | −10 | +30 |
| Ex. 46 | −10 | +5 | 835 | 225 | −10 | +30 |
| Ex. 47 | −10 | +5 | 830 | 225 | −10 | +30 |
| Ex. 48 | −10 | +5 | 835 | 225 | −10 | +30 |
| Ex. 49 | −5 | +5 | 840 | 220 | −10 | +15 |
| Ex. 50 | −5 | +5 | 840 | 215 | −10 | +15 |
| Ex. 51 | −5 | +5 | 840 | 220 | −10 | +15 |
| Ex. 52 | −5 | +5 | 835 | 215 | −10 | +15 |

Ex.: Example

TABLE 6

| | Before long-term durability test | | After long-term durability test | | | |
|---|---|---|---|---|---|---|
| | ΔVd(ab) [V] | ΔVI(ab) [V] | Vdc [V] | VIc [V] | ΔVd(cb) [V] | ΔVI(cb) [V] |
| C. E. 1 | −10 | +10 | 790 | 310 | −50 | +55 |
| C. E. 2 | −10 | +10 | 785 | 310 | −40 | +55 |
| C. E. 3 | −10 | +10 | 800 | 300 | −40 | +50 |
| C. E. 4 | −10 | +10 | 800 | 300 | −40 | +50 |
| C. E. 5 | −10 | +10 | 800 | 310 | −45 | +60 |
| C. E. 6 | −10 | +15 | 810 | 300 | −40 | +65 |
| C. E. 7 | −10 | +10 | 810 | 300 | −40 | +45 |
| C. E. 8 | −10 | +15 | 800 | 330 | −40 | +50 |
| C. E. 9 | −15 | +10 | 800 | 340 | −55 | +55 |
| C. E. 10 | −10 | +25 | 810 | 350 | −50 | +65 |
| C. E. 11 | −15 | +20 | 800 | 315 | −50 | +60 |
| C. E. 12 | −15 | +10 | 780 | 230 | −45 | +55 |
| C. E. 13 | −15 | +10 | 790 | 230 | −40 | +50 |

C. E.: Comparative Example

Accordingly, aspects of the present invention can provide an electrophotographic photosensitive member whose short-term potential variation is suppressed even after long-term repeated use.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2009-263083 filed Nov. 18, 2009 and No. 2010-209419 filed Sep. 17, 2010, which are hereby incorporated by reference herein in their entirety.

What is claimed is:

1. An electrophotographic photosensitive member comprising:

a support;

an intermediate layer formed on the support; and a photosensitive layer formed on the intermediate layer, wherein the intermediate layer comprises metal oxide particles, an organic resin, and at least one selected from the group consisting of a compound represented by the structural formula (1-1), a compound represented by the structural formula (1-3) and a compound represented by the structural formula (1-4) below:

(1-1)

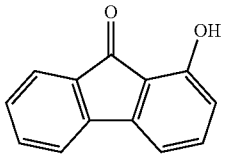

(1-3)

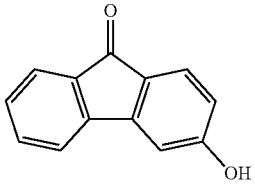

(1-4)

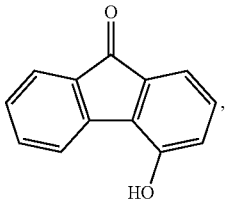

the metal oxide particles are particles of titanium oxide or zinc oxide, and the organic resin is a polyamide resin or a polyurethane resin.

2. The electrophotographic photosensitive member according to claim 1, wherein the intermediate layer comprises at least one selected from the group consisting of a compound represented by the formula (1-1), a compound represented by the formula (1-3) and a compound represented by the formula (1-4) in an amount of 0.05% or more and 4.00% or less by mass relative to the amount of the metal oxide particles.

3. The electrophotographic photosensitive member according to claim 1, wherein the intermediate layer comprises the organic resin in an amount of 10% or more and 50% or less by mass relative to the amount of the metal oxide particles.

4. The electrophotographic photosensitive member according to claim 3, wherein the intermediate layer comprises the organic resin and the compound represented by the structural formula (1-1).

5. The electrophotographic photosensitive member according to claim 1, wherein the metal oxide particles are particles of zinc oxide.

6. A process cartridge detachably mountable to a main body of an electrophotographic apparatus, the process cartridge comprising:

the electrophotographic photosensitive member according to claim 1; and at least one unit selected from a charging unit, a developing unit, a transferring unit, and a cleaning unit, wherein the process cartridge integrally supports the electrophotographic photosensitive member and the at least one unit.

7. An electrophotographic apparatus comprising:

the electrophotographic photosensitive member according to claim 1;

a charging unit;

an exposure unit;

a developing unit; and a transferring unit.

* * * * *